US012392587B2

(12) United States Patent
Xia

(10) Patent No.: US 12,392,587 B2
(45) Date of Patent: Aug. 19, 2025

(54) DEFORMABLE HOLLOW DART HEAD FOR TOY DART AND TOY DART WITH THE SAME

(71) Applicant: HuizhouShi Xute Plastic Electronic Technology Co., Ltd., Huizhou (CN)

(72) Inventor: Xubin Xia, Huizhou (CN)

(73) Assignee: HuizhouShi Xute Plastic Electronic Technology Co., Ltd., Huizhou (CN)

( * ) Notice: Subject to any disclaimer, the term of this patent is extended or adjusted under 35 U.S.C. 154(b) by 200 days.

(21) Appl. No.: 18/483,500

(22) Filed: Oct. 9, 2023

(65) Prior Publication Data

US 2024/0328762 A1 Oct. 3, 2024

(30) Foreign Application Priority Data

Mar. 29, 2023 (CN) ..... 202320679132.6
Jun. 16, 2023 (CN) ..... 202321539807.3

(51) Int. Cl.
*A63B 65/02* (2006.01)
*F42B 6/00* (2006.01)

(52) U.S. Cl.
CPC ..... *F42B 6/003* (2013.01)

(58) Field of Classification Search
CPC ..... F42B 6/003
See application file for complete search history.

(56) References Cited

U.S. PATENT DOCUMENTS 6,083,127 A * 7/2000 O'Shea ..... A63H 33/18 446/213
9,459,081 B2 10/2016 Chia
9,964,383 B2 * 5/2018 Chang ..... B29C 65/18
10,018,451 B1 7/2018 Ma
11,073,367 B2 7/2021 Chia et al.
11,592,271 B2 * 2/2023 Chia ..... F42B 12/745
2006/0276277 A1 * 12/2006 Montefusco ..... F42B 8/16 102/502
2024/0142205 A1 * 5/2024 Chia ..... F42B 6/00
2024/0167798 A1 * 5/2024 Johnson ..... F42B 6/003

FOREIGN PATENT DOCUMENTS

CN 203053330 U 7/2013

* cited by examiner

*Primary Examiner* — John A Ricci

(57) ABSTRACT

A deformable hollow dart head for a toy dart includes a dart cap and a connector, the dart cap has a cap top and a cylindrical cap wall extending from a periphery of the cap top, the cap wall is provided with air vents, the connector has a circular base connecting with the cap wall, thereby sealing the dart cap to form a deformable cavity, the material of the dart cap is softer than that of the circular base. At the moment when the dart toy hits a target, the dart cap contacts and impacts the target. The target exerts a reactive force on the dart toy, and the deformable cavity provides deformation space for the dart cap, thereby causing the dart cap to deform and increasing the contact area with the target.

10 Claims, 4 Drawing Sheets

DEFORMABLE HOLLOW DART HEAD FOR TOY DART AND TOY DART WITH THE SAME

FIELD OF THE INVENTION

The present invention relates to the technical field of toy darts, more particularly, to a deformable hollow dart head for a toy dart and a toy dart with the same.

BACKGROUND OF THE INVENTION

Chinese Utility Model No.: CN201320034331.8 discloses a toy dart for a toy gun, which includes a dart head and a dart body, the dart head includes a cushion and a connector, and both ends of the connector are respectively connected with the cushion and the dart body, and the cushion is made of flexible material and configured to reduce the impact force of the toy dart on the shooting target when colliding with it. However, the cushion with the above configuration is difficult to deform or has limited deformation, and cannot effectively reduce the impact force of the toy dart on the shooting target.

SUMMARY OF THE INVENTION

The present invention provides a deformable hollow dart head for a toy dart to overcome the deficiencies that the toy dart in the prior art "is difficult to deform or has limited deformation, and cannot effectively reduce the impact force of the toy dart on the shooting target".

The deformable hollow dart head for a toy dart includes a dart cap and a connector, the dart cap has a cap top and a cylindrical cap wall extending from the periphery of the cap top, the cap wall is provided with two air vents, the connector has a circular base connecting with the cap wall, thereby sealing the dart cap to form a deformable cavity, the material of the dart cap is softer than that of the circular base.

The circular base is provided with a connecting ring on a side facing the dart cap, the connecting ring is plugged into the dart cap to fit the cap wall, and a height of the connecting ring is smaller than that of the cap wall.

The circular base, the connecting ring, and the cap wall are bonded by an adhesive.

The present invention further provides a toy dart with the aforementioned deformable hollow dart head for a toy dart.

The circular base is connected with a dart body on the other side opposing to the dart cap, the circular base separates the dart body and the dart cap.

The other side of the circular base is provided with a plug-in column, the dart body is a long cylindrical shape with an inner cavity, and the plug-in column is inserted into the inner cavity of the dart body to connect it.

The outer wall of the plug-in column is provided with multiple adhesive grooves, which are used to accommodate adhesive and connect the plug-in column and the dart body.

A toy dart includes a dart cap, a dart body, and a connector. The connector has a circular base. The dart cap has a cap top and a cylindrical cap wall extending from the periphery of the cap top, the cap body has a cylindrical body with opposite end faces and a cavity passing through the opposite end faces. The dart cap and the dart body are respectively disposed on opposite two sides of the circular base and connected thereto. The circular base is connected with the cap wall and seals the dart cap to form a deformable cavity. The material of the dart cap is softer than that of the circular base. The cap wall of the dart cap is provided with two air vents to communicate the deformable cavity and the outside.

The opposite two sides of the circular base are respectively provided with a connecting ring and a plug-in column, the outer diameter of the connecting ring and the outer diameter of the plug-in column are smaller than the outer diameter of the circular base. The connecting ring is inserted into the dart cap to adhere to the cap wall, and the height of the connecting ring is smaller than that of the cap wall. The plug-in column is inserted into the cavity of the dart body to connect the dart cap and the dart body. The plug-in column of the connector is provided with grooves.

The benefit of the present invention: the deformable hollow dart head for the toy dart in the present invention, at the moment when the dart toy shoots a target, the dart cap contacts and impacts the target. The target exerts a reactive force on the dart toy, and the deformable cavity provides deformation space for the dart cap, thereby causing the dart cap to deform and increasing the contact area with the target. At the same time, due to the deformation of the deformable cavity, the gas therein is discharged through the air vents, and the circular base carries the dart body forward and is affected by the deformation of the dart cap, thereby reducing the impact force on the target. The circular base provides support for the deformation of the dart cap, ensuring the stability of the dart head.

In the present invention, the opposite two sides of the circular base are respectively arranged with the dart body and the dart cap. The circular base separates the dart cap and the dart body. The dart body, the dart cap, and the connector are respectively made from different materials. If the three are bonded by the adhesive, it will increase the performance requirements for the adhesive, greatly increasing the production difficulty. However, in the present invention, the dart cap only contacts with the circular base, and the dart body only contacts with the circular base, thereby the adhesive only needs to bond the dart cap and the circular base, or the dart body with the circular base, it greatly reduces the performance requirements for the adhesive, thereby reducing the production cost and the production difficulty.

In the present invention, the dart body adopts a hollow cylindrical structure with a large aspect ratio and a front center of gravity, during flight, the aerodynamic center of the dart body is located behind the center of gravity, which has a balance and stability effect, avoiding the impact of wind force, air resistance, and other factors on the dart toy, and maintaining the flight stability and speed of the dart toy.

EMBODIMENTS

Figure 1:
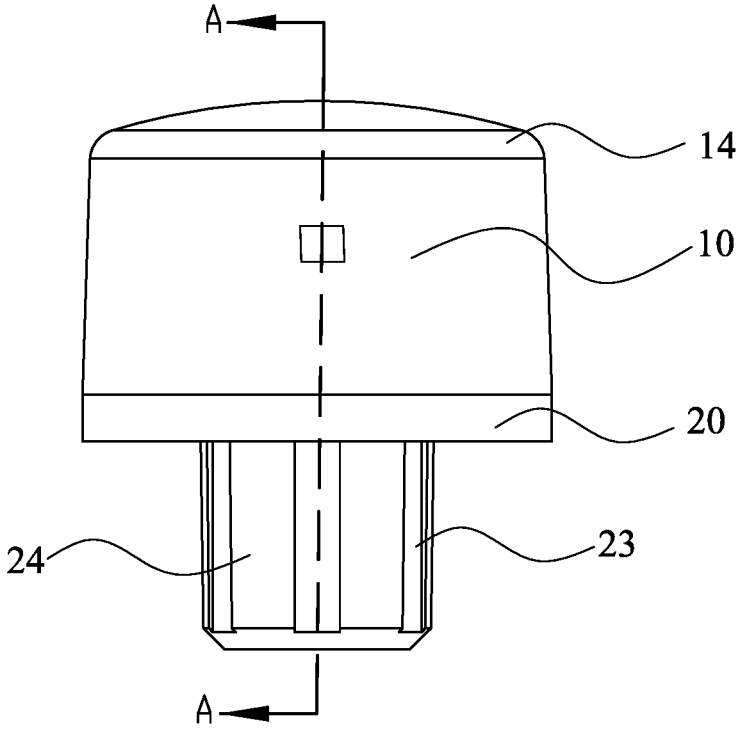
FIG. 1 is a perspective view of the deformable hollow dart head of a dart toy according to an embodiment in the present invention.
Figure 2:
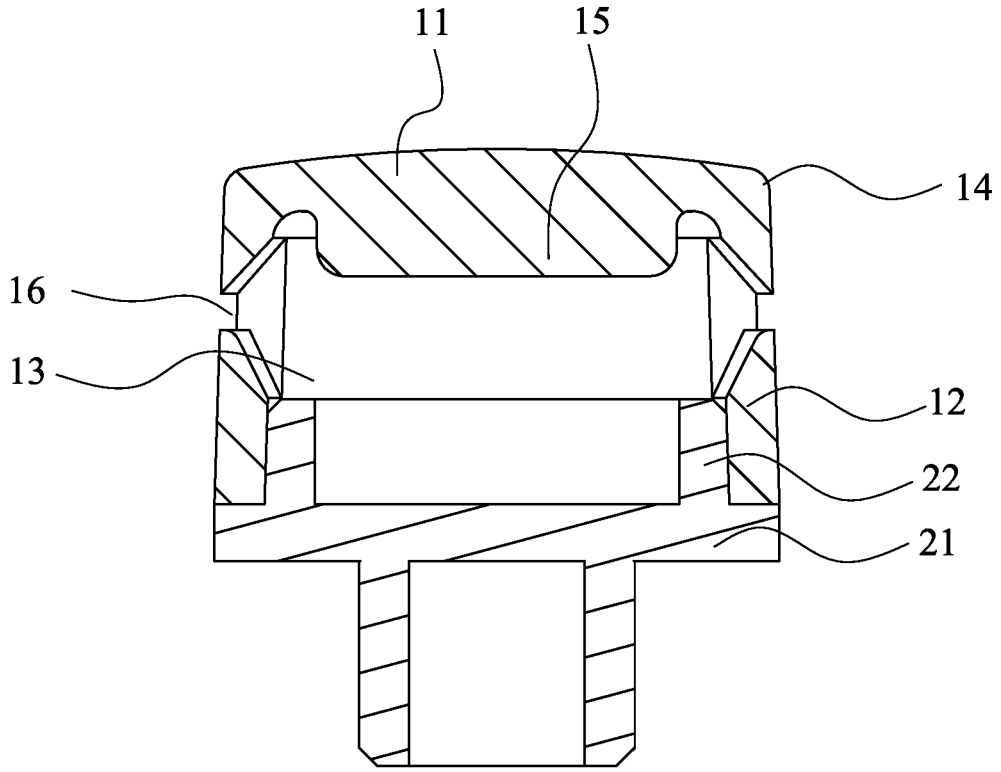
FIG. 2 is a section view along the A-A line of FIG. 1.

In order to make the purpose, the technical solution, and the technical effect of the present invention clearer, the following will further explain the present invention in conjunction with specific implementation methods. It should be understood that the specific embodiments described here are only intended to explain the present invention and are not intended to limit it.

Referring to FIG. 1-4, the deformable hollow dart head for a toy dart includes a dart cap 10 and a connector 20. The dart cap 10 has a cap top 11 and a cylindrical cap wall 12 extending from a periphery of the cap top 11, the cap wall 12 is provided with air vents 16. The connector 20 has a circular base 21 connecting with the cap wall 12, thereby sealing the dart cap 10 to form a deformable cavity 13. The dart cap 10 and the connector 20 are both made of flexible materials such as rubber and thermo-plastic-pubber material. The material of the dart cap 10 is softer than that of the connector 20. The deformable hollow dart head for a toy dart is mounted on the dart body 20 by a circular base 21, thereby forming a dart toy. At the moment the dart toy hits the shooting target, the dart cap 10 contacts and impacts the target. The target exerts a reactive force on the dart toy, and the deformable cavity 13 provides deformation space for the dart cap 10, thereby causing the dart cap 10 to deform and increasing the contact area with the target. At the same time, due to the deformation of the deformable cavity 13, the gas therein is discharged through the air vents 16, and the circular base 21 carries the dart body 30 forward and is affected by the deformation of the dart cap 10, thereby reducing the impact force on the shooting target. The circular base 21 provides support for the deformation of the dart cap 10, ensuring the stability of the dart head.

The circular base 21 is provided with a connecting ring 22 on a side facing the dart cap 10. The connecting ring 22 is plugged into the dart cap 10 to fit the cap wall 12, and a height of the connecting ring 22 is smaller than that of the cap wall 12. The connecting ring 22 is set to insert into the dart cap 10 so as to increase the connection strength between the dart cap 10 and the circular base 21, thereby preventing them from falling off easily and improving product quality. The height of the connecting ring 22 is set to be smaller than the cap wall 12 to prevent it from affecting the deformation of the dart cap 10 and increasing the deformation difficulty of the dart cap 10. The height of the connecting ring 22 is preferably ⅓ of the cap wall 12. In addition, the connecting ring 22 is inserted into the dart cap 10 and fits with the cap wall 12, thereby relatively positioning the connecting ring 22 and the dart cap 10, so that their center-lines are coincided, thereby reducing installation errors and improving the shooting accuracy of the dart head. The cap wall 12 is outside the connecting ring 22, the joint of the cap wall 12 and the connecting ring 22 is difficult to deform, ensuring their centerlines to be coincided and improving the shooting accuracy of the dart head.

The circular base 21, the connecting ring 22, and the cap wall 12 are bonded by adhesive, thereby increasing the adhesion strength and preventing the dart cap 10 and the connecting ring 20 from falling off easily and improving product quality.

The circular base 21 is connected with a dart body 30 on the other side opposite to the dart cap 10, the dart body 30 and the circular base 21 are bonded by an adhesive. The circular base 21 separates the dart body 30 and the dart cap 10. The commonly used dart body 30 on the market is preferably made of EPE Foam (Polyethylene foam) material, while the dart cap 10 in the invention is made of softer flexible rubber, thermo-plastic-pubber material, and other materials, and the circular base 21 is made of harder rubber, thermo-plastic-pubber material, and other materials. The circular base 21 is set to separate the dart cap 10 and the dart body 30, which can avoid high requirements for adhesive performance due to the mixed bonding of the three different materials. In the present invention, the dart cap 10 only contacts with the circular base 21, and the dart body 30 only contacts with the circular base 21, the requirement for adhesive between two materials is greatly reduced, thereby saving costs and reducing production difficulty.

The other side of the circular base 21 is provided with a plug-in column 23, the dart body 30 is a long cylindrical shape with an inner cavity, and the plug-in column 23 is inserted into the inner cavity of the dart body 30 to connect it.

The outer wall of the plug-in column 23 is provided with multiple adhesive grooves 24, which are used to accommodate adhesive and connect the plug-in column 23 and the dart body 30. The adhesive groove 24 is preferably uniformly distributed on the plug-in column 23.

The periphery of the cap top 11 is set as a circle, and it slightly bulges from the periphery to the middle. The circular hat top 11 increases the contact area between the hat top 11 and the target when the dart toy hits the shooting target, reducing the impact force borne by the target. The slightly raised structure facilitates the dart toy to reduce air resistance and increase flight speed during flight.

The joint 14 between the cap top 11 and the cap wall 12 forms an arc-shaped transition, thereby reducing the difficulty of deformation of the dart cap 10 and facilitating its deformation.

The middle part of the hat top 11 protrudes inward with a circular platform 15, which increases the deformation difficulty of the middle part of the hat top 11 relative to the other parts of the dart cap 10. When the dart cap 10 deforms, the other parts deform with the center of the circular platform 15 and extend laterally, thereby increasing the contact area between the target and the dart cap 10.

Figure 3:
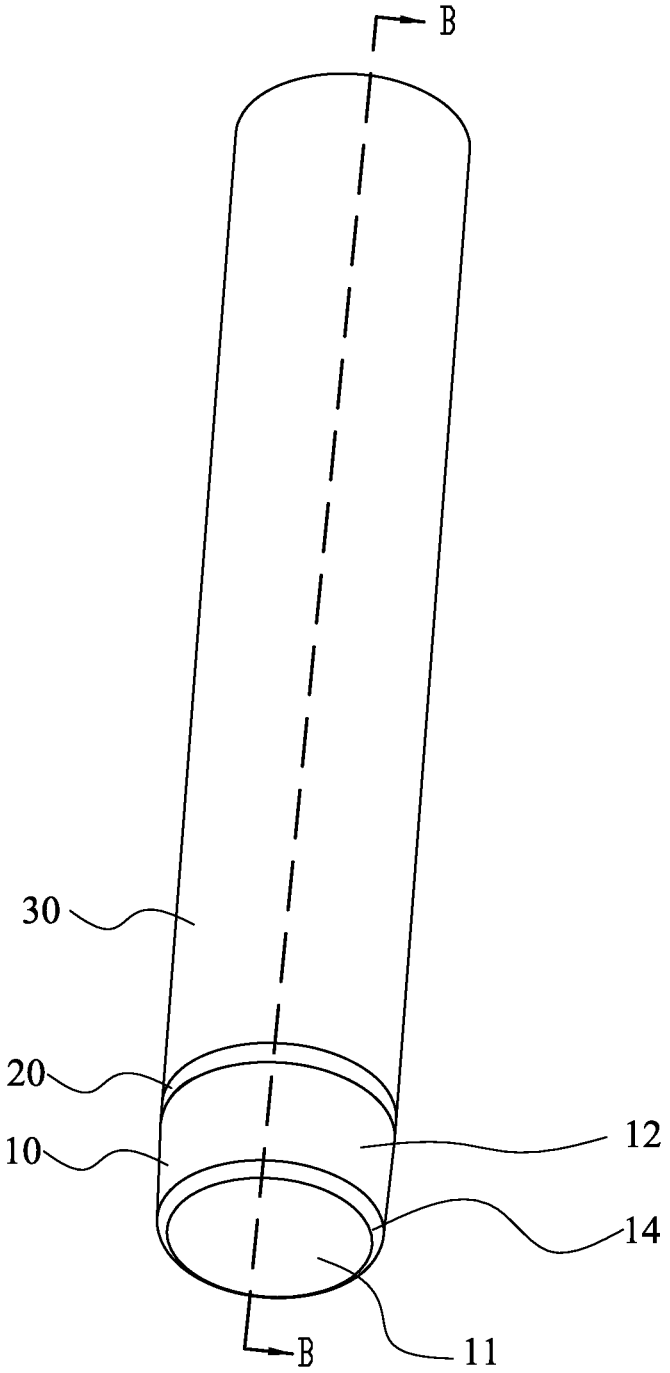
FIG. 3 is a perspective view of the dart toy according to an embodiment in the present invention.
Figure 4:
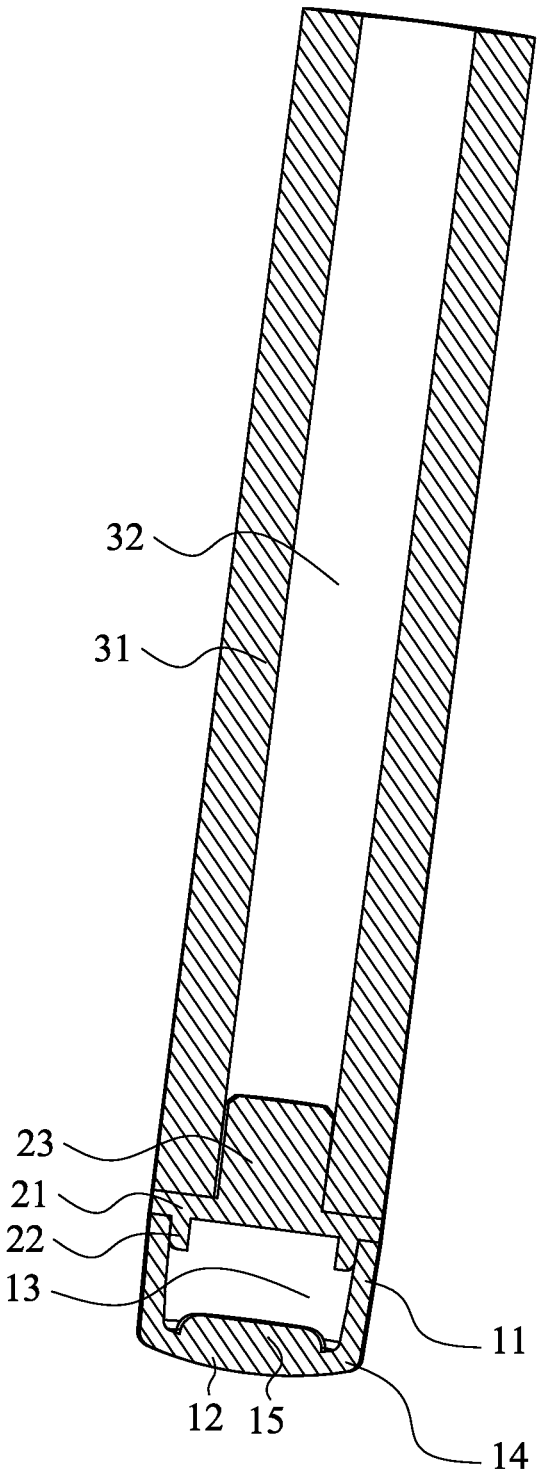
FIG. 4 is a section view along the B-B line of FIG. 3.

Referring to FIG. 3 and FIG. 4, a toy dart includes a dart cap 10, a dart body 30 and a connector 20. The connector 20 has a circular base 21. The dart cap 10 has a cap top 11 and a cylindrical cap wall 12 extending from a periphery of the cap top 11, the cap wall 12 is provided with air vents 16. The cap body 30 has a cylindrical body 31 with opposite two end faces and a cavity 32 passing through the opposite two end faces. The dart cap 10 and the dart body 30 are respectively disposed on the opposite two sides of the circular base 21 and connected thereto. The circular base 21 is connected with the cap wall 12 and seals the dart cap 10 to form a deformable cavity 13. The dart cap 10 and the connector 20 are both made of flexible rubber, thermo-plastic-pubber material, and other materials. The dart body 30 is made of EPE Foam (Polyethylene foam) cotton, and the material of the dart cap 10 is softer than that of the circular base 21. The cap wall 12, the body 31, and the circular base 21 have the same radial outer diameter and are connected to form a long cylindrical toy dart.

At the moment the dart toy shoots the target, the dart cap 10 contacts and impacts the target. The target exerts a reactive force on the dart toy, the dart cap 10 directly bears the reactive force from the target, and the deformable cavity 13 provides deformation space for the dart cap 10, thereby causing the dart cap 10 to deform and increasing the contact area with the target. At the same time, the circular base 21 carries the dart body 30 forward and is affected by the deformation of the dart cap 10, thereby reducing the impact force on the target. The circular base 21 provides support for the deformation of the dart cap 10, ensuring the stability of the dart head. The dart body 30 has a balancing and stabilizing effect during flight, avoiding the impact of wind force, air resistance, etc. on the dart, and maintaining its flight stability and speed.

The joint 14 between the cap top 11 and the cap wall 12 forms an arc-shaped transition, thereby reducing the deformation difficulty of the dart cap 10 and facilitating its deformation.

The opposite two sides of the circular base 21 are respectively provided with a connecting ring 22 and a plug-in column 23, the out diameter of the connecting ring 22 and the out diameter of the plug-in column 23 are smaller than the outer diameter of the circular base 21. The connecting ring 22 is inserted into the dart cap 10 to adhere to the cap wall 12, and the height of the connecting ring 12 is smaller than that of the cap wall 12. The plug-in column 23 is inserted into the cavity 32 of the dart body 30 to connect the dart cap 10 and the dart body 30. The connecting ring 12 is set to insert into the dart cap 10 so as to increase the connection strength between the dart cap 10 and the circular base 21, thereby preventing them from falling off easily and improving product quality. The height of the connecting ring 22 is set to be smaller than the cap wall 12 to prevent it from affecting the deformation of the dart cap 10 and increasing the deformation difficulty of the dart cap 10. The height of the connecting ring 22 is preferably ⅓ of the cap wall 12. The dart body 30 is set with a cavity 32 to further move the overall center of gravity of the toy dart forward, ensuring flight stability.

The outer side of the connecting ring 22 is bonded with the inner side of the cap wall 12 through adhesive, and the outer side of the plug-in column is bonded with the inner side of the body 31 through adhesive; thus increasing the bonding strength, preventing the detachment of the dart cap 10, the dart body 30, and the connector 20, and improving product quality.

Preferably, the opposite two sides of the circular base 21 are respectively attached with the end surface of the cap wall 12 and one end of the dart body 30 and bonded by adhesive to increase the bonding strength, preventing the detachment of the dart cap 10, the dart body 30, and the connector 20, and improving product quality. The circular base 21 separates the dart cap 10 and the dart body 30. The commonly used dart body 30 on the market is preferably made of EPE Foam (Polyethylene foam) material, while the dart cap 10 in the invention is made of softer flexible rubber, thermo-plastic-pubber material, and other materials, and the circular base 21 is made of harder rubber, thermo-plastic-pubber material, and other materials. The circular base 21 is set to separate the dart cap 10 and the dart body 30, which can avoid high requirements for adhesive performance due to the mixed bonding of the three different materials. In the present invention, the dart cap 10 only contacts with the circular base 21, and the dart body 30 only contacts with the circular base 21, the requirement for adhesive between two materials is greatly reduced, thereby saving costs and reducing production difficulty.

The outer wall of the plug-in column 23 is provided with multiple adhesive grooves 24, which are used to accommodate adhesive and connect the plug-in column 23 and the dart body 30.

The periphery of the cap top 11 is set as a circle, and it slightly bulges from the periphery to the middle. The circular hat top 11 increases the contact area between the hat top 11 and the target when the dart toy hits the target, reducing the impact force borne by the target. The slightly raised structure facilitates the dart toy to reduce air resistance and increase flight speed during flight.

The joint 14 between the cap top 11 and the cap wall 12 forms an arc-shaped transition, thereby reducing the difficulty of deformation of the dart cap 10 and facilitating its deformation.

The middle part of the hat top 11 protrudes inward with a circular platform 15, which increases the deformation difficulty of the middle part of the hat top 11 relative to the other parts of the dart cap 10. When the dart cap 10 deforms, the other parts deform with the center of the circular platform 15 and extend laterally, thereby increasing the contact area between the target and the dart cap 10.

Figure 5:
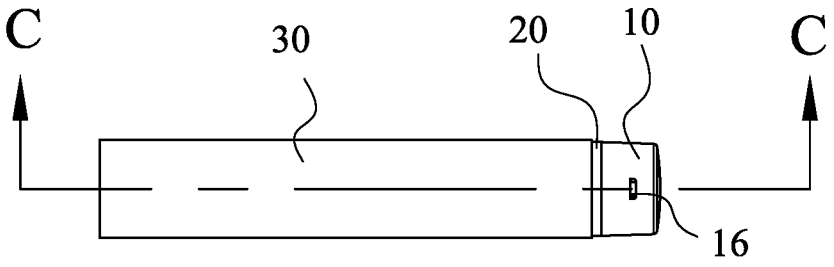
FIG. 5 is the other perspective view of the dart toy according to an embodiment in the present invention.
Figure 6:
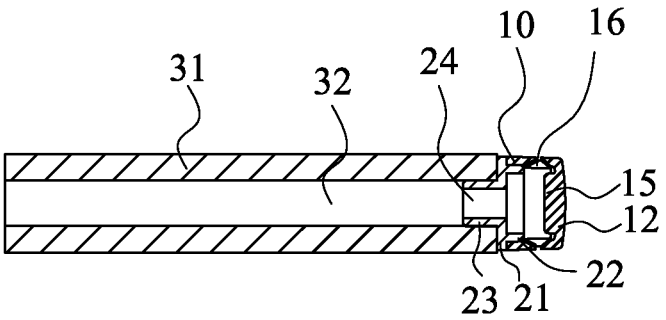
FIG. 6 is a section view along the C-C line of FIG. 5.
Figure 7:
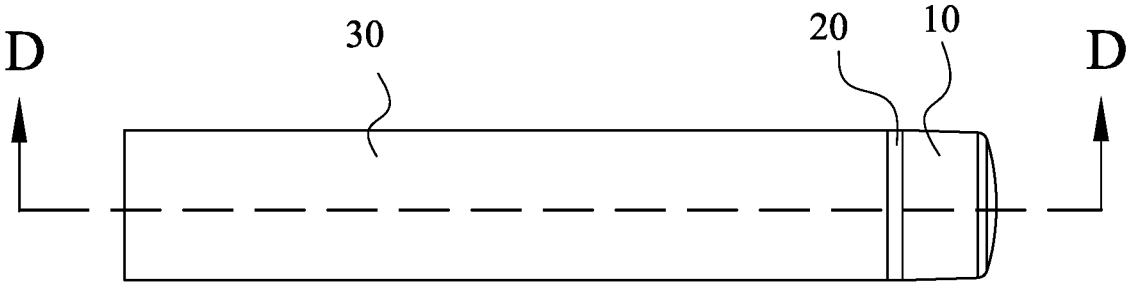
FIG. 7 is another perspective view of the dart toy according to an embodiment in the present invention.
Figure 8:
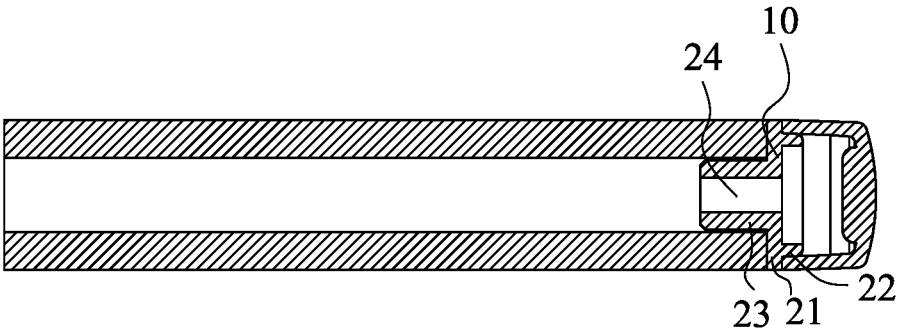
FIG. 8 is a section view along the D-D line of FIG. 7.

Referring to FIG. 5 and FIG. 6, the wall of the dart cap 10 is provided with air vents 16 communicated with the deformable cavity and the outside. When the dart head is deformed, the air vents 16 are used for exhaust.

Referring to FIG. 5 and FIG. 6, preferably, the connector 20 is provided with a groove 24, the groove 24 is arranged on the plug-in column 23 to reduce the weight of the connector 20 and the weight of the toy dart.

The dart body adopts a hollow cylindrical structure with a large aspect ratio and a front center of gravity, during flight, the acrodynamic center of the dart body is located behind the center of gravity, which has a balance and stability effect, avoiding the impact of wind force, air resistance, and other factors on the dart toy, and maintaining the flight stability and speed of the dart toy.

Preferably, the dart body 30 is made of polyethylene foam cotton, the dart cap 10 is made of softer thermo-plastic-pubber material, the connector 20 is made of harder thermo-plastic-pubber material which is facilitate to bond the dart body 30 and the connector 20 by adhesive, the bonding effect is good.

The above content is a further detailed explanation of the present invention based on the specific preferred implementation methods, and it cannot be considered that the specific implementation of the present invention is limited to these explanations. For ordinary technical personnel in the technical field to which this present invention belongs, without departing from the concept of this present invention, its architectural form can be flexible and varied, and a series of products can be derived. Just making a few simple deductions or substitutions should be considered as belonging to the scope of patent protection of this present invention determined by the submitted claims.

The invention claimed is:

1. A deformable hollow dart head for a toy dart, comprising a dart cap and a connector, said dart cap has a cap top and a cylindrical cap wall extending from a periphery of said cap top, said cap wall is provided with air vents, said connector has a circular base connecting with said cap wall, thereby sealing said dart cap to form a deformable cavity, a material of said dart cap is softer than that of said circular base.

2. The deformable hollow dart head for said toy dart according to claim 1, wherein said circular base is provided with a connecting ring on a side facing said dart cap, said connecting ring is plugged into said dart cap to fit said cap wall, and a height of said connecting ring is smaller than that of said cap wall.

3. The deformable hollow dart head for said toy dart according to claim 2, wherein said circular base, said connecting ring, and said cap wall are bonded by an adhesive.

4. The deformable hollow dart head for a toy dart according to claim 1, wherein said periphery of said cap top is set as a circle, and slightly bulges from said periphery of said cap top to a middle of said cap top; said middle part of said cap top protrudes inward with a circular platform, a joint between said cap top and said cap wall forms an arc-shaped transition.

5. A toy dart, comprising a deformable hollow dart head for a toy dart, said deformable hollow dart head for said toy dart comprises a dart cap and a connector, said dart cap has a cap top and a cylindrical cap wall extending from a periphery of said cap top, said cap wall is provided with air vents, said connector has a circular base connecting with said cap wall, thereby sealing said dart cap to form a deformable cavity, a material of said dart cap is softer than that of said circular base.

6. The toy dart according to claim 5, wherein said circular base is connected with a dart body on a side opposing to said dart cap, said circular base separates said dart body and said dart cap.

7. The toy dart according to claim 6, wherein said circular base is provided with a plug-in column on said side opposing to said dart cap, said dart body is a long cylindrical shape with an inner cavity, and said plug-in column is inserted into said inner cavity of said dart body to connect said dart body.

8. The toy dart according to claim 7, wherein an outer wall of said plug-in column is provided with multiple adhesive grooves, which are used to accommodate adhesive and connect said plug-in column and said dart body.

9. A toy dart, comprising a dart cap, a dart body, and a connector; said connector has a circular base; said dart cap has a cap top and a cylindrical cap wall extending from a periphery of said cap top, said cap body has a cylindrical body with opposite two end faces and a cavity passing through said opposite two end faces; said dart cap and said dart body are respectively disposed on opposite two sides of said circular base and connected thereto; said circular base is connected with said cap wall and seal said dart cap to form a deformable cavity; a material of said dart cap is softer than that of said circular base; said cap wall of said dart cap is provided with air vents to communicate said deformable cavity and an outside.

10. The toy dart according to claim 9, wherein said opposite two sides of said circular base is respectively provided with a connecting ring and a plug-in column, an out diameter of said connecting ring and an out diameter of said plug-in column are smaller than an outer diameter of said circular base; said connecting ring is inserted into said dart cap to adhere to said cap wall, and a height of said connecting ring is smaller than that of said cap wall; said plug-in column is inserted into said cavity of said dart body to connect said dart cap and said dart body; said plug-in column of said connector is provided with grooves.

* * * * *